US007481135B2

(12) United States Patent
Schoenbeck et al.

(10) Patent No.: US 7,481,135 B2
(45) Date of Patent: Jan. 27, 2009

(54) HAND TOOL WITH ADJUSTABLE HEAD

(75) Inventors: Michael D. Schoenbeck, Lake Orion, MI (US); David T. Ross, Beach Park, IL (US); Christopher D. Thompson, Franklin, WI (US); Jeffery H. Hoff, Salem, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 11/881,879

(22) Filed: Jul. 30, 2007

(65) Prior Publication Data

US 2007/0272060 A1 Nov. 29, 2007

Related U.S. Application Data

(63) Continuation of application No. 10/993,571, filed on Nov. 19, 2004, now abandoned.

(51) Int. Cl.
*B25B 23/16* (2006.01)

(52) U.S. Cl. ..... 81/177.7; 81/177.8; 16/110.1; 16/900

(58) Field of Classification Search ..... 81/177.7–177.9; 16/110.1, 900; 403/160, 96, 57, 102–104, 403/106, 84, 90; D8/306, 61–62
See application file for complete search history.

(56) References Cited

U.S. PATENT DOCUMENTS 2,542,038 A 2/1951 Lewis
4,170,909 A 10/1979 Wagner
4,759,240 A 7/1988 Lin
4,833,950 A 5/1989 Moncada
D305,975 S 2/1990 Emmerling
5,069,091 A 12/1991 Bramsiepe et al.
5,142,953 A 9/1992 Lin
5,329,834 A 7/1994 Wong
5,372,420 A 12/1994 Van Deursen et al.
5,606,758 A 3/1997 Tung
D383,365 S 9/1997 Lee
5,737,982 A 4/1998 Lin (Continued)

OTHER PUBLICATIONS

Matco Tools, We're The Source, 2002-2003 Professional Handtools and Service Equipment, cover and p. 148, item RPS01.

(Continued)

*Primary Examiner*—D. S Meislin
(74) *Attorney, Agent, or Firm*—Seyfarth Shaw LLP

(57) ABSTRACT

A hand tool includes a head that is adjustable to a plurality of positions. The head is pivotally mounted to a tool body at a pivot axis. A bearing structure is attached at the pivot axis by a hub or fastener, about which the head may be adjusted. An actuator is positioned between the body and the head and acts to lock the head in a predetermined position with respect to the tool body. A plurality of radial slots are provided on a cavity or a bearing structure and receive the actuator in order to lock the tool head in a predetermined position relative to the tool body. The adjustable head allows for the tool to be manipulated to engage fasteners in hard to reach areas and also allow an operator to apply extra torque to the fastener.

24 Claims, 5 Drawing Sheets

U.S. PATENT DOCUMENTS

| | | | |
|---|---|---|---|
| 5,836,430 | A | 11/1998 | Vasudeva |
| 5,839,579 | A | 11/1998 | Lee |
| 5,943,921 | A | 8/1999 | Lin |
| 6,039,126 | A | 3/2000 | Hsieh |
| 6,058,812 | A | 5/2000 | Casel et al. |
| 6,102,134 | A | 8/2000 | Alsruhe |
| 6,131,490 | A | 10/2000 | Lee |
| 6,151,995 | A | 11/2000 | Shu |
| D441,267 | S | 5/2001 | Heun |
| 6,308,599 | B1 | 10/2001 | Fu-Hui |
| 6,349,619 | B1 | 2/2002 | Liao |
| 6,364,033 | B1 | 4/2002 | Hung et al. |
| 6,386,074 | B1 | 5/2002 | Yang |
| 6,405,620 | B2 | 6/2002 | Liao |
| 6,450,067 | B1 | 9/2002 | Liao |

OTHER PUBLICATIONS

Photographs (3) of Matco tool, item RPS01, three views (admitted prior art).

Photograph (1) of Craftsman tool, items 47450 WR (admitted prior art).

HAND TOOL WITH ADJUSTABLE HEAD

REFERENCE TO RELATED APPLICATIONS

This application is a continuation of now abandoned U.S. application Ser. No. 10/993,571, filed Nov. 19, 2004.

BACKGROUND

Many hand tools (electric and manual) are known that have a unitary body and handle having a longitudinal axis collinear with the axis of rotation of a drive member (e.g. screwdriver head). Such hand tools may not be useful for hard-to-access fasteners. Also, in some applications, it may be desirable to apply extra torque to a fastener by positioning the handle so that it is not collinear with the axis of rotation of the drive member. In order to solve such problems it has been known to provide a head of the hand tool that may pivot or rotate on the handle, so that the head is angled, for example at 90°, from the longitudinal axis of the handle. The pivoting of the head in such a way, allows for the use of the tool in places that are difficult to access. However, such previous tools have complicated designs with many parts that are difficult to assemble. Also such previous designs have locking means that are complicated to use and are expensive to manufacture. The present hand tool overcomes such disadvantages.

SUMMARY

The present invention provides for an adjustable-head hand tool comprising a body having a handle and a pivot axis, a head mounted to the body for pivotal movement about the pivot axis, an actuator carried by one of the body and the head for reciprocating movement between a release condition accommodating relative pivotal movement of the body and the head and a locking condition to lock the head in a predetermined position with respect to the body, a bearing structure carried by one of the body and the head and received by a cavity of the other of the body and the head and the bearing structure having an end face bearing surface and the cavity having a bottom bearing surface and the bearing structure secured within the cavity by a boss so that the end face bearing surface and the bottom bearing surface are in abutting contact and upon which the head may be adjusted relative to the body and one of the bearing structure and the cavity having a plurality of radial slots for receiving the actuator when in the locking condition.

In an embodiment, the bearing structure may protrude from the head and may be received in a cavity formed in the body. In an embodiment, the bearing structure may protrude from the body and may be received in a cavity formed in the head. In an embodiment, the end face bearing surface may include a chamfer for engaging a corresponding chamfered surface of the cavity. In an embodiment, the boss may include a retaining ring for securing the head to the body. In an embodiment, the boss may provide for a fastener that includes a screw that is threaded into the bearing structure in order to secure the bearing structure within the cavity. In an embodiment, the boss may include a snap-fit cap.

In an embodiment, the bearing structure may include a channel for receiving the actuator. In an embodiment, the actuator may be slidably mounted in a channel formed in the body and in communication with the cavity. In an embodiment, the actuator may be slidably mounted in a channel formed in the head and in communication with the cavity. In an embodiment, the head may include a ratchet mechanism for operation of a drive member protruding from the head. In an embodiment, the actuator may be generally L-shaped and may include a finger contact leg for engaging a finger of an operator's hand and a lock leg for engaging one of the slots.

In an embodiment, the slots may be oriented around an inner diameter wall of the cavity and the actuator is mounted in a channel formed in the outer diameter wall of the bearing structure and the actuator is spring biased to provide the actuator in the locking condition by engaging one of the slots located adjacent the channel upon rotation of the head to the predetermined position. In an embodiment, the cavity may be formed by an insert having a hole for receiving the hub therethrough. In an embodiment, the boss may protrude from the end face bearing surface of the bearing structure. In an embodiment, a pair of angular bearing surfaces may be formed between the head and body and the bearing surfaces are formed at 45° from a longitudinal axis of the body.

In an embodiment, the body may include a channel extending generally parallel to a longitudinal axis of the body and a passage extending generally perpendicular to and in communication with the channel. In an embodiment, the actuator may be generally T-shaped and may include an actuator body having a terminal end, an axial finger opposite the terminal end and a slide lever that extends from the actuator body, the actuator body disposed in the channel and the slide lever extending through the passage and protruding from the body for engagement by an operator's finger in order to move the actuator. In an embodiment, the terminal end of the actuator body may be received within the cavity and engages one of the slots. In an embodiment, the axial finger may engage a spring disposed within the channel for biasing the actuator to the locking condition by engaging one the slots located adjacent the channel upon rotation of the head to the predetermined position. In an embodiment, a stop abutment may be located on one of the bearing structure and the cavity for limiting rotation of the head to less than 360°. In an embodiment, the stop abutment restricts rotation of the head to 180° or less.

In another embodiment, the invention provides for an adjustable-head hand tool comprising a body including a cavity having a bottom forming a bottom bearing surface, a head including a bearing structure having an end face bearing surface to be received by the cavity in abutment with the bottom bearing surface and a boss protruding from the bearing structure and received in a hole of the cavity for providing a pivot axis about which the head is rotated.

In an embodiment, the boss may include a fastener for fastening the head to the body. In an embodiment, the boss may include a retaining ring for securing the head to the body. In an embodiment, the head may include a channel extending between the cavity and an exterior opening on the head. In an embodiment, the channel may be disposed in the bearing structure.

In an embodiment, the body may include a first bearing surface surrounding the cavity and the head may include a second bearing surface surrounding the bearing structure. In an embodiment, the bearing structure may provide a third bearing surface that abuts a fourth bearing surface provided by an elevation formed in a bottom of the cavity. In an embodiment, the bearing structure may include a stop abutment that may provide a fifth bearing surface that may abut a sixth bearing surface provided by a bottom of the cavity. In an embodiment, the end face bearing surface may include the third and fifth bearing surfaces and the bottom bearing surface may include the fourth and sixth bearing surfaces.

In a further embodiment, the invention provides for a method for adjusting the head of a hand held tool comprising the steps of providing a body having a head pivotally mounted thereto and the tool including an actuator disposed in a channel and a bearing structure carried by one of the body and the head and received by a cavity of the other of the body and the head, grasping the body in a hand of an operator, sliding the actuator through the channel with the operator's finger or thumb to release the actuator from a first slot, rotating the head so that the bearing structure rotates within the cavity about a pivot axis to a predetermined position and releasing the actuator so that it engages a second slot at the predetermined position in order to lock the head in the predetermined position.

In an embodiment, the method may further comprising the step of sliding the actuator between a release condition accommodating relative pivotal movement of the body and the head and a locking condition to lock the head in the predetermined position. In an embodiment, the tool may provide for five slots and the head may be rotated between five positions by alternating the actuator between the release condition and the locking condition. In an embodiment, the channel may be disposed in the head and the method further comprising the step of sliding the actuator through the channel to protrude into the cavity in order to engage a slot disposed in the cavity.

In an embodiment, the invention provides for an adjustable-head hand tool comprising a body having a pivot axis, a head mounted to the body for pivotal movement about the pivot axis, a means for actuating the pivotal movement, a means for locking the head in a predetermined position with respect to the body and a means for restricting rotation of the head relative to the body.

In an other embodiment, the actuating means may include an actuator carried by one of the body and the head for reciprocating movement in and out of a plurality of slots. In an embodiment, the locking means may include a plurality of radial slots disposed within the body for receiving the actuator in order to lock the head in a predetermined position. In an embodiment, the restricting means may include a stop abutment disposed on the head. In an embodiment, the body may include a cavity for receiving the head therein and an elevation may be provided within the cavity for abutting the stop abutment and preventing complete rotation of the head relative to the body beyond 180°.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION

Figure 1:
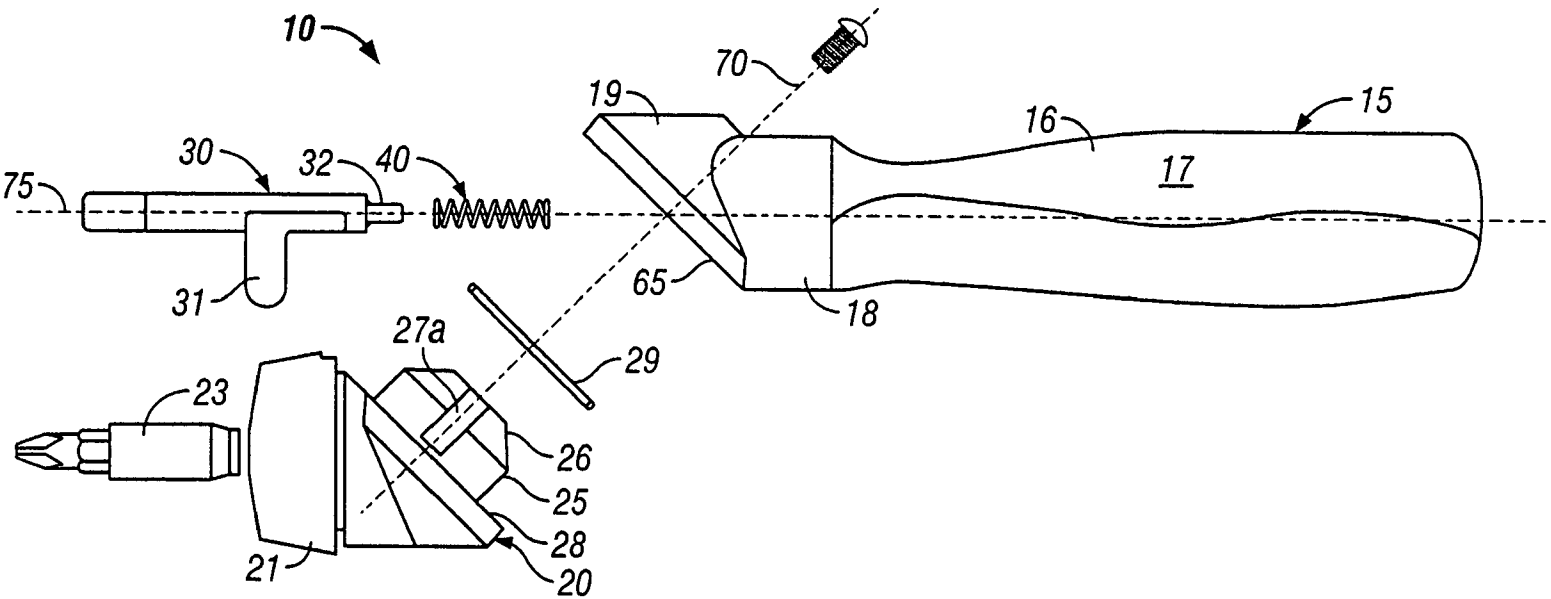
FIG. 1 is a side elevation exploded view of a hand tool.

A first embodiment of hand tool 10 is depicted in FIGS. 1-4. The hand tool 10 includes a body 15. The body 15 includes a handle 16. The handle 16 may include a gripping surface 17. A neck 18 and shoulder 19 are formed at an end of the body 15.

The tool 10 includes a head 20 with a collar 21 having a ratcheting mechanism 22 provided therein and a drive member 23 attached thereto. In an embodiment, the drive member may be a bit, such as a Phillips-head or regular screwdriver bit. Other drive members 23, such as square or hex shaped drive members, may be provided as well. In other embodiments, the tool may or may not provide for ratcheting.

Protruding from the head 20 is a hub or bearing structure 25. In an embodiment, the bearing structure 25 has a cylindrical shape having an end face bearing surface 26. In an embodiment, the end face includes a chamfered end. Radial slots 27*a*, 27*b*, 26*c* (and a fourth slot not shown in FIGS. 1-4) are formed on the bearing structure 25 at angularly spaced locations. A second bearing surface 28 is formed at the base of the bearing structure 25. In an embodiment, an O-ring 29 may be mounted on the bearing surface 28.

Figure 2:
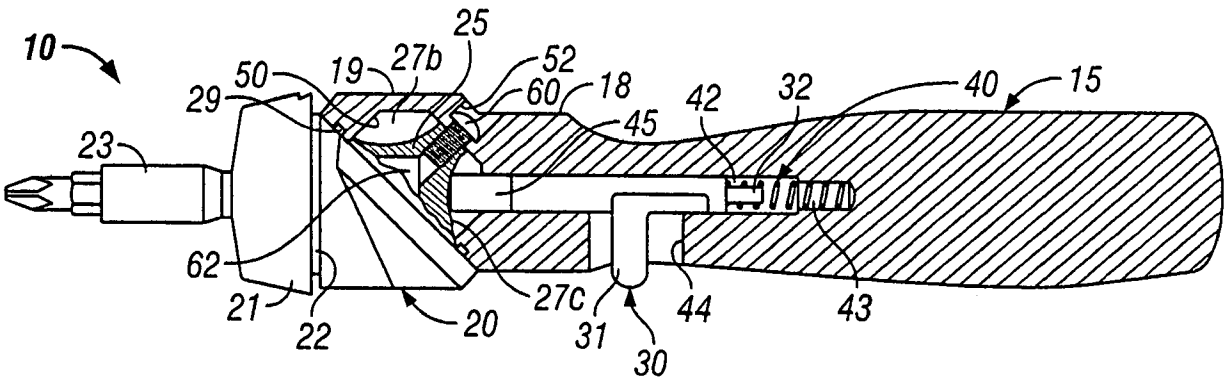
FIG. 2 is an assembled, partially sectioned view of the hand tool of FIG. 1 depicting an actuator in a locking condition maintaining the head in a first position.

An elongated actuator 30 is provided that includes a slider lever 31 and an axial finger 32 for receiving a bias member 40. In an embodiment, the bias member 40 may be a coil spring or other resilient member. The actuator 30 and the bias member 40 are received within a channel 42 formed in the body 15. In an embodiment, the channel 42 is formed along a longitudinal axis of the body 15. A reduced diameter portion 43 receives the bias member 40 therein so that a portion of the bias member 40 protrudes into the channel 42. A radial passage 44 is formed in communication with the channel 42 and receives the slider lever 31 therein. In an embodiment, the slider lever 31 is L-shaped so that it is attached along the body of the actuator 30 and extends perpendicularly from the actuator 30 through the passage 44, so that it protrudes beyond the outer surface of the body 15. The actuator 30 is mounted within the channel 42 so that the finger 32 is received within the bias member 40. The channel 42 is formed having a length greater than the length of the actuator 30 so that the actuator may slide axially within the channel 42 for reciprocating movement between the head 20 and body 15. As shown in FIG. 2, the actuator 30 is in its locking condition where its terminal end 45 is engaging the slot 27*c* of the bearing structure 25. The bias member 40 acts on the actuator 30 to bias it to a locked condition (moved all the way to the left, as shown in FIG. 2).

A cavity 50 is formed within the shoulder 19 of the body 15. In an embodiment, the cavity 50 has a corresponding shape to the bearing structure 25 and the cavity 50 has a diameter slightly greater than the diameter of the bearing structure 25. The cavity includes a bottom bearing surface. In an embodiment, the bottom bearing surface includes a chamfered bottom to receive the chamfered end and end face bearing surface 26 of the bearing structure 25. An aperture 52 is located between the neck 18 and shoulder 19 of the body 15 and is formed in communication with the cavity 50. A fastener or boss 60 is mounted in the aperture 52 and engages a threaded cavity 62 formed in the center of the bearing structure 25. Therefore, it may be understood that by inserting the bearing structure 25 within the cavity 50 of the body 15, the bearing structure 25 may be secured to the body 15 by the fastener 60.

In an embodiment, as shown in FIGS. 1-4, the fastener 60 may be a screw with a head. When the screw is tightened, it captures the bearing structure 25 within the cavity 50 and the head 20 may rotate so that the bearing structure 25 bears against the inner surfaces of the cavity 50 and the bearing surface 28 bears against a first bearing surface or bearing face 65 of the body 15. In an embodiment, a pivot axis 70 is formed that is 90° from the bearing face 65. In an embodiment, the bearing face 65 is angular and formed at 45° from the longitudinal axis 75 of the body 15. The head 20, in an embodiment, is mounted to the body 15 so that its threaded cavity 62 is collinear with the aperture 52 of the body 15, each of which are located on the pivot axis 70. In an embodiment, the O-ring 29 is provided at the bearing face 65 adjacent the second bearing surface 28 in order to restrict debris from entering the cavity 50.

FIGS. 1-4 depict the bearing face 65 is formed at a 45° angle from the longitudinal axis 75 of the body 15. In alternate embodiments, the bearing face 65 may be formed at other angles which would affect the rotated angle at which the head 20 may be positioned relative to the body 15.

FIG. 2 depicts the tool 10 in an orientation where the head 20 is positioned so that the rotational axis of the drive member 23 is collinear with the longitudinal axis 75 (as shown in FIG. 1) of the body 15. The head 20 is maintained in this collinear position by the actuator 30 located in its locking condition as shown in FIG. 2, with the terminal end 45 received within the slot 27*c* of the bearing structure 25 so that it prevents the bearing structure 25 from rotating. The bias member 40 helps to keep the terminal end 45 in position within the slot 27*c* by bearing against the finger 32 at the opposite end of the actuator 30.

Figure 3:
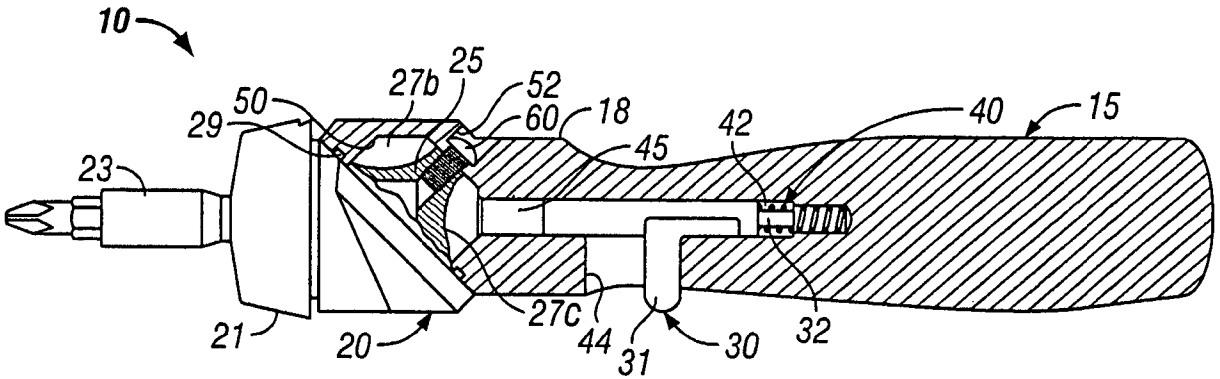
FIG. 3 is a view similar to FIG. 2, with the actuator in a release condition.

The head 20 may be rotated from its collinear position (FIG. 2) by disengaging the actuator 30 from the slot 27 as shown in FIG. 3. The actuator 30 is moved (to the right as shown in FIG. 3) to a release condition and compresses the bias member 40. The diameter of the channel 42 is greater than the diameter of the actuator 30 so that the actuator 30 is easily moved within the channel 42 by engaging the end of the slider lever 31 with an operator's finger, in order to move the slider lever 31 to the edge of the passage 44, as shown in FIG. 3. Therefore, the terminal end 45 of the actuator 30 is disengaged from the channel 27*c*, so that the bearing structure 25 may freely rotate within the cavity 50. In an embodiment, while holding the actuator 30 in the unlocking condition (for example, with the user's right hand with index finger on the slider lever 31), the user may use his other (left) hand to grab the head 20 around the collar 21 and rotate or swivel the head to an alternate position.

Figure 4:
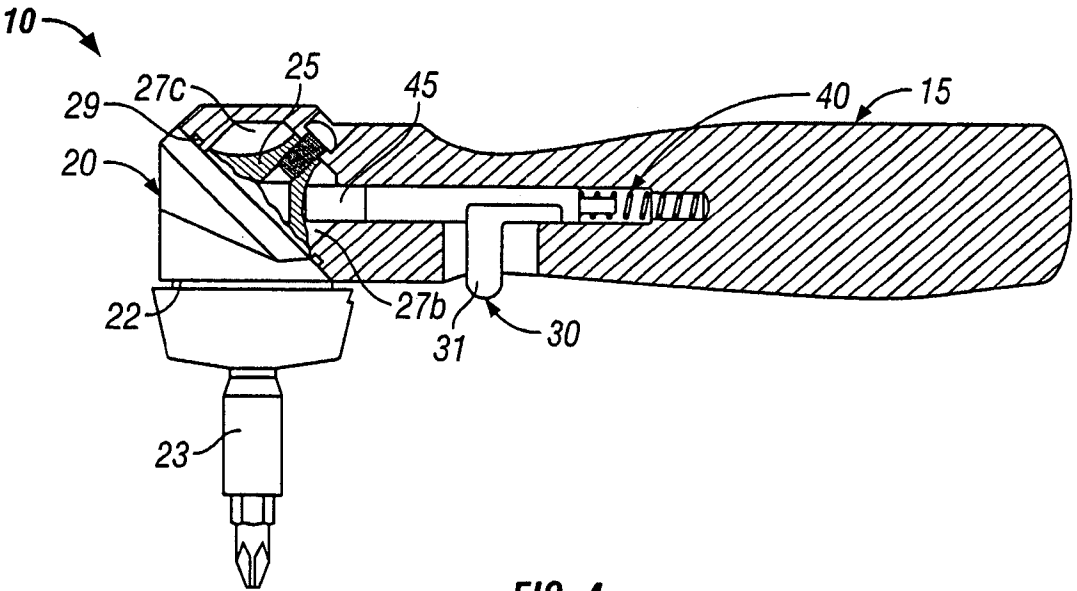
FIG. 4 is a view similar to FIG. 2, but with the head in a second position and the actuator in a locking condition.

For example, FIG. 4 shows the head 20 positioned at a right angle to the longitudinal axis 75 (FIG. 1) of the body 15. The head is rotated so that the slot 27*c* of the bearing structure 25 is rotated 180° so that slot 27*b* is then oriented in a position in communication with the channel 42. After movement to this second position, the actuator 30 is released by removing the user's finger from the slider lever 31, so that the bias member 40 acts on the actuator in order to push it into its locked condition with the terminal end 45 received within the slot 27*b* of the bearing structure 25. As shown in FIG. 4, the head 20 is oriented so that the rotational axis of the drive member 23 is perpendicular to the longitudinal axis 75 of the body 15.

FIGS. 1-4 depict the head 20 in a first and second position. In an embodiment, the tool is constructed so that the head may be rotated or adjusted to multiple positions. For example, the bearing structure 25 may include four slots 27*a*, 27*b*, 27*c*, (fourth slot not shown) located at 90° intervals about the circumference of the bearing structure 25. In such a way, the head 20 may be rotated into four positions: 90°, 45°, collinear with the longitudinal axis of the handle and 45° (on the opposite side). However, it may be understood that additional positions may be provided by adding additional slots to the bearing structure 25. As well, continuous rotation of the head may be restricted by adding a stop abutment to the bearing structure 25 in order to stop 360° (or other angles of) rotation of the head 20. For example, it may be desirable to restrict the tool 10 from reaching the 90° position as this may be a position in which the drive member 23 and ratcheting mechanism 22 receive the greatest amount of wear and increase warranty issues with the tool 10. However, in any case it may be understood that by rotation of the head 20, as described above, the versatility of the tool 10 is increased because it can be used to access hard-to-reach areas and also allow for increased torque to be applied by the drive member 23 due to the angled position of the handle 16. In an embodiment, the tool 10 is non-motorized.

Figure 5:
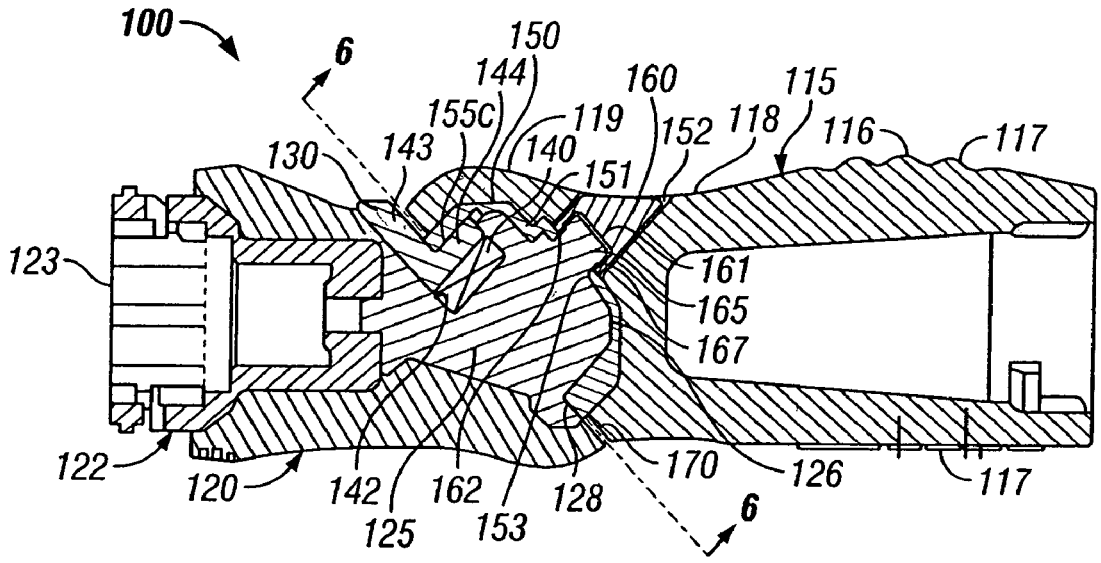
FIG. 5 is a section view of an alternate embodiment of the hand tool of FIG. 1.
Figure 6:
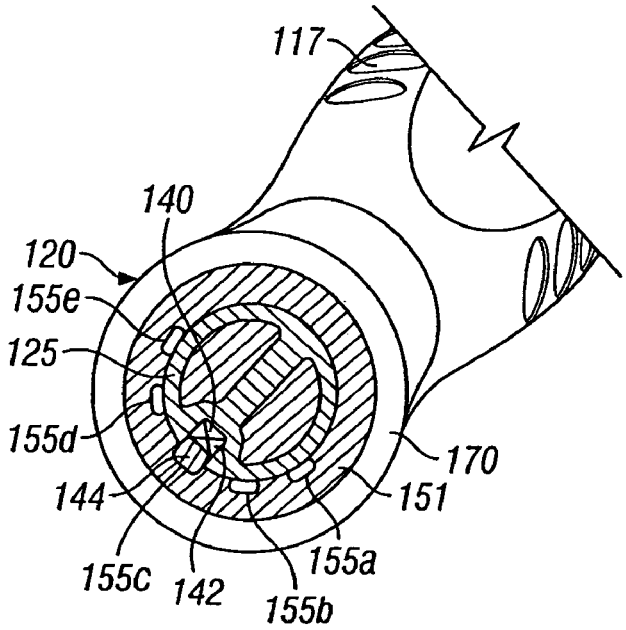
FIG. 6 is a sectional view taken at line 6-6 of FIG. 5.
Figure 7:
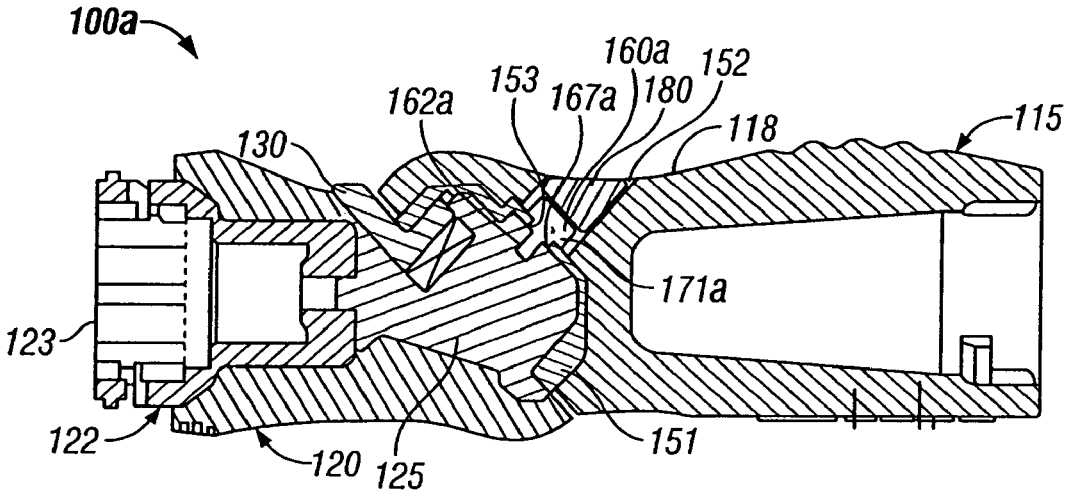
FIG. 7 is a view similar to FIG. 5 of a further alternate embodiment of the hand tool of FIG. 5.
Figure 8:
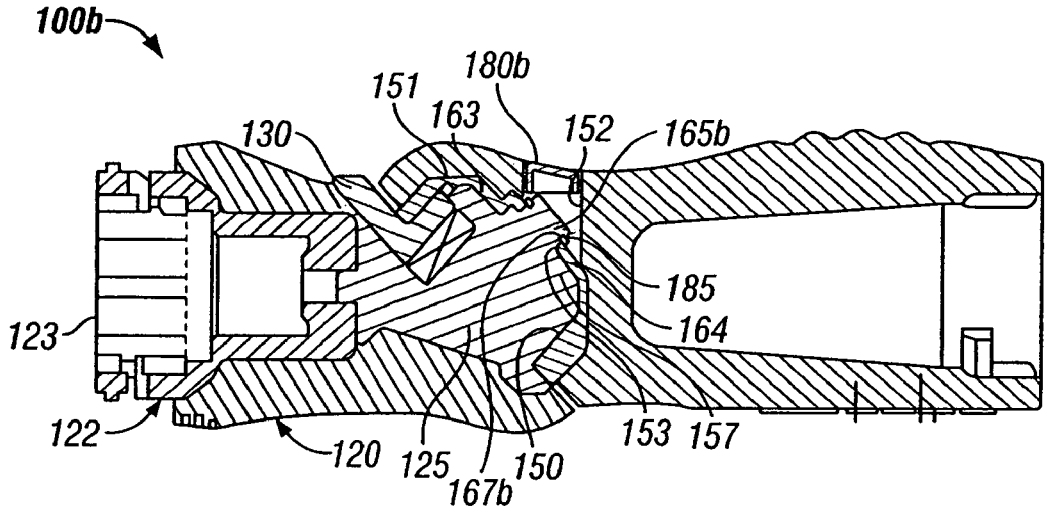
FIG. 8 is a view similar to FIG. 7 of another alternate embodiment of the hand tool of FIG. 5.

Turning to FIGS. 5-9, additional embodiments of the tool will be discussed. FIGS. 5, 7 and 8 respectively depict three alternate embodiments 100, 100*a*, 100*b* of the tool of the present application. Each of these embodiments share many components in common, which will be described hereinafter with like numerals for FIGS. 5-9. Each of the hand tools 100, 100*a*, 100*b* includes a body 115 and includes a handle 116 which may include a gripping surface 117. A neck 118 and shoulder 119 are provided at an end of the body 115.

A head 120 is provided which includes a ratcheting mechanism 122 that includes a socket 123 for receiving a bit or bit holder, such as a drive member or Phillips head or regular screw drive adapter (as shown in FIGS. 1-4). The head 120 includes a hub or bearing structure 125 that protrudes from the head 120. In an embodiment, the bearing structure 125 has a cylindrical shape and includes an end face bearing surface 126. In an embodiment, the end face bearing surface includes a chamfered end 126. A first bearing surface 170 is formed on the body 115 surrounding a cavity 150 and a second bearing surface 128 is formed at the base of the bearing structure 125 on the head 120.

An actuator 130 and a bias member 140 are received in a channel 142 formed in the head 120 and provide a means for actuating pivotal movement of the head 120 with respect to the body 115. The channel 142, is formed so that it is generally L-shaped in cross section, as shown in FIGS. 5, 7 and 8. The channel 142 is formed in the bearing structure 125 and extends radially along the bearing surface 128. In an embodiment, the actuator 130 is generally L-shaped. The actuator 130 includes a finger contact leg 143 and a lock leg 144. When received in the channel 142, the lock leg 144 of the actuator 130 abuts against the bias member 140 and the finger contact leg 143 protrudes from the edge of the head 120.

A cavity 150 is formed in the body 115 and an insert 151 is provided within the cavity 150. In an embodiment, the insert 151 is formed having a cavity that is shaped corresponding to the shape of the bearing structure 125 and includes a bottom bearing surface having a chamfered bottom to receive the chamfered end 126 of the bearing structure 125. In an embodiment, the outer body 115 is insert molded around the insert 151. An aperture 152 is formed in the body 115 that is in communication with the cavity 150 and is located between the neck 118 and shoulder 119 of the body 115. In an embodiment, the insert 151 includes a hole 153. The hole 153 provides for a communication passage between the cavity 150 and the aperture 152. The insert 151 includes slots 155*a*, 155*b*, 155*c*, 155*d*, 155*e* formed along the inner-diameter wall of the insert 151 to receive the lock leg 144 of the actuator 130. Each of the slots 155*a*, 155*b*, 155*c*, 155*d*, 155*e* (shown in FIG. 6) may receive the lock leg 144 when the head is rotated to various positions in order to provide a means for locking the head 120 in predetermined positions with respect to the body 115. FIG. 6 depicts the head 120 in a first position and the lock leg 144 received in slot 155*c*.

A fastener 160 secures the bearing structure 125 to the body 115. FIG. 5 depicts an embodiment where the fastener 160 is a snap-fit cap. The snap-fit cap is received within the aperture 152 and includes an opening 161 having an annular lip 162. The opening 161 receives a boss 165 protruding from the center of the bearing structure 125. The boss is cylindrical in shape and includes a reduced diameter neck 167 for receiving the lip 162 of the snap-fit cap 160.

In an embodiment, the preferred method of assembling the tool 100 depicted in FIG. 5 includes the steps of inserting the bearing structure 125 within the cavity 150, so that the boss 165 is inserted through the hole 153 of the insert 151 and is received within the aperture 152. The snap-fit cap 160 is then placed into the aperture 152 so that the opening 161 surrounds the boss 165 and the lip 162 snap-fits into the neck 167 of the boss 165 in order to retain the boss 165 within the aperture 152. Thus, it is to be understood that by placing the snap-fit cap 160 securely over the boss 165, the lip 162 prevents the boss 165 from returning back through the hole 153 of the insert 151. In an embodiment, the neck 167 may rotate freely against the lip 162 so that the bearing structure 125 may rotate freely within the cavity 150 and insert 151. Upon rotation, the bearing structure 125 bears against the inner-surface of the insert 151. As well, the second bearing surface 128 will bear against a first bearing surface face 170.

Therefore, it may be understood that upon rotation of the head 120 and bearing structure 125 within the cavity 150, the channel 142 will also rotate with the head 120. As shown in FIGS. 5-8, the head 120 is locked in a first position collinear with the handle 115 (e.g. the rotational axis of the ratchet mechanism 122 is collinear with the longitudinal axis of the handle 115). The head 120 is locked in the first position by the lock leg 144 of the actuator 130 being received in the channel 155*c* is a locking condition and retained therein by the force of the bias member 140. In order to rotate the head 120 to a different position, the actuator 130 is depressed by pushing on the finger contact leg 143 in order to compress the bias member 140 and push the actuator 130 further into the channel 142 to a release condition to release the lock leg 144 from its slot (for example, slot 155*c* as shown in FIG. 6).

In an embodiment, a user's hand may grasp the end of the head 120 so that his or her index finger or thumb is placed on the tip of finger contact leg 143. Upon depression of the actuator 130, the lock leg 144 is removed from slot 155*c* and the user may rotate the head 120. The head 120 may rotate until the lock leg 144 is adjacent the next slot. For example, if the head 120 is rotated in a clockwise direction and the user releases his/her finger or thumb from the actuator 130, the lock leg 144 will travel to the slot 155*d* (as shown in FIG. 6) and the bias member 140 will push the lock leg 144 into the slot 155*d* in order to lock the head 120 in the next position. In an embodiment, each of the slots 155*a*, 155*b*, 155*c*, 155*d*, 155*e* may be oriented at 30° intervals. Thus, the head may be positioned at 30° from the first collinear position (shown in FIGS. 5 and 6) by rotating the actuator 130 to either slot 155*b* or slot 155*d*. Likewise, the head 120 may be positioned at 60° from the first collinear position by rotating the head 120 until the actuator 130 engages either slot 155*a* or slot 155*e*. Therefore, the embodiment depicted may have five positions.

In an embodiment, the bearing structure 125 may include a stop abutment 157 that provides a means for restricting the head 120 from rotating beyond each of the 60° positions in either direction. However, in an alternate embodiment rotation may be provided to 360°, or some increment less than 360° such as 180°. It may be understood that slots may be placed in any position around the cavity 150 in alternate embodiments, at varying intervals so that the head 120 may be placed in any desired position. This description of the locking features of the tool are similar for the embodiments for FIGS. 7-9.

FIG. 7 depicts a further alternate embodiment of the tool. The tool 100*a* depicted in FIG. 7, operates in a similar fashion to the tool of FIGS. 5 and 6, with the exception of the particular fastener which retains the bearing structure 125 within the cavity 150. As shown in FIG. 7 the fastener 160*a* is a screw. The screw 160*a* includes a neck 167*a* and a head 171*a*. The screw 160*a* is received in a threaded cavity 162*a* formed in the top of the bearing structure 125. In an embodiment, the tool 100 may be assembled by placing the bearing structure 125 within cavity 150, so that the threaded cavity 162*a* is aligned with the hole 153 and aperture 152. The fastener 160*a* is inserted through aperture 152 and the hole 153 of the insert 151.

The fastener 160*a* is then threaded into the threaded cavity 162*a* of the bearing structure 125. Upon completely threading the screw 160*a* into the threaded cavity 162*a*, the neck 167*a* abuts the hole 153 of the insert 151 and the head 171*a*, which has a larger diameter than the hole 153, restricts axial movement of the bearing structure 125. In an embodiment, a slight gap may be provided between the head 171*a* of the screw 160*a* and the insert 151 adjacent the hole 153. Therefore, slight axial movement of the bearing structure 125 may be allowed. After securement of the fastener 160*a*, the bearing structure 125 may freely rotate within the cavity 151 and plug 180 may be inserted into the aperture 152*a*. In an embodiment, the end of the plug 180 may be contoured so that it corresponds to the outer-contour of the body 115 at the neck 118.

Figure 9:
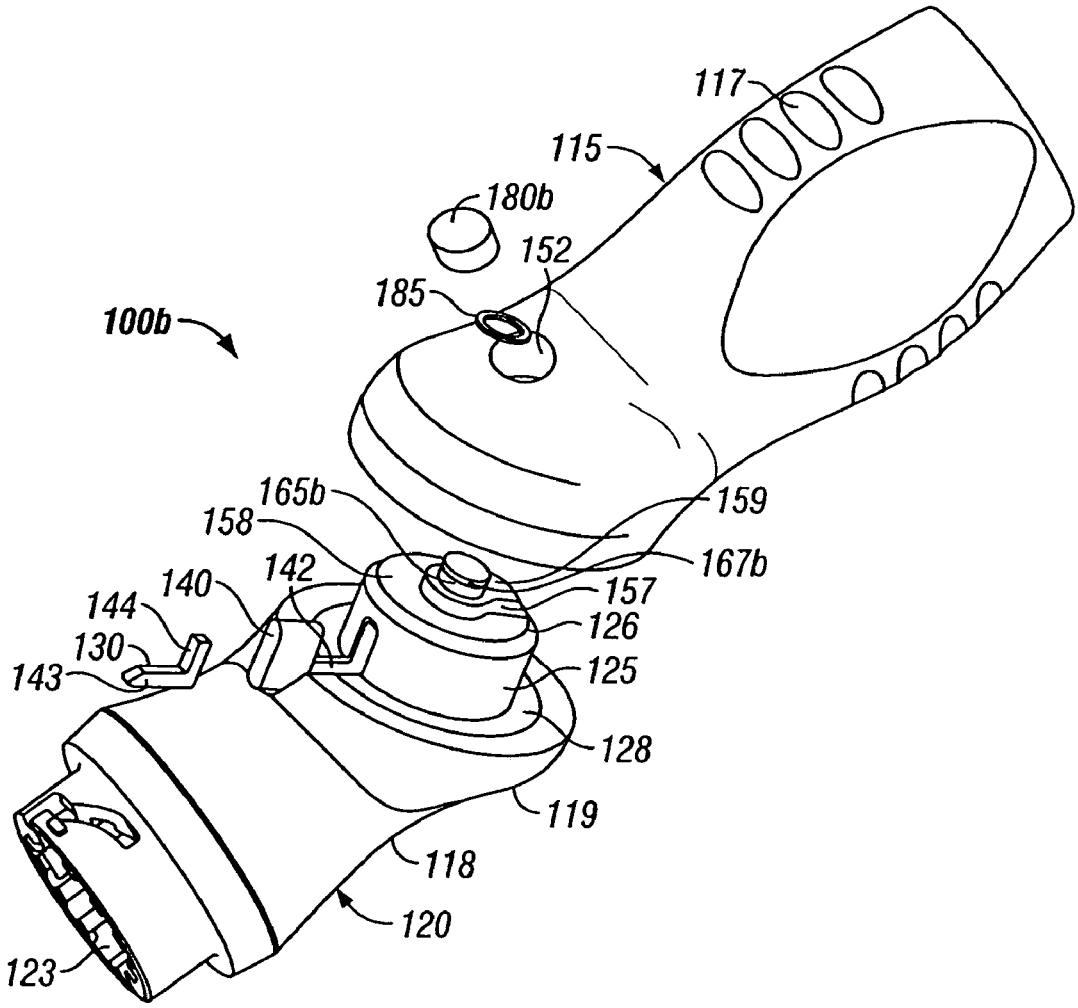
FIG. 9 is an exploded perspective view of the hand tool of FIG. 8.

Turning to FIGS. 8 and 9, another alternate embodiment of the tool 100*b* is depicted. The tool 100*b* generally operates as has been previously discussed for FIGS. 5-7 above, except that the fastener for affixing the bearing structure 125 within the cavity 150 is modified. A boss 165*b* is provided which includes an annular groove 167*b*. The annular groove 167*b* receives a rigid retaining ring 185. The retaining ring 185, in an embodiment, has an outer-diameter which is greater than the diameter of hole 153 formed in the insert 151, so that the ring 185 may retain the boss 165*a* within the aperture 152. Thus, the ring 185 acts to retain the bearing structure 125 within the cavity 150. In an embodiment, the tool may be assembled by placing the bearing structure 125 within the cavity 150 and insert 151 so that the boss 165*a* is inserted through the hole 153 of the insert 151. The retaining ring 185 is then inserted through the aperture 152 and over the boss 165*a* to be received in the annular groove 167*b*. A plug 180*b* is then placed within the aperture 152. The tool may then operate, as discussed above, with the bearing structure 125 freely rotating within the cavity 150, except for the actuator 130 which restricts rotation by abutting slots formed in the insert 151.

FIG. 8 also depicts the stop abutment 157 that protrudes above a third bearing surface 158 at the end of the bearing structure 125 that abuts a fourth bearing surface provided by an elevation 163 formed by a bottom of the cavity 150. As shown in FIG. 9, the stop abutment 157 is positioned at about the 3 o'clock position on the bearing structure 125 and provides the fourth bearing surface 159. In an embodiment, the elevation 163 is generally crescent shaped and extends between the 7 o'clock and 11 o'clock position and forms the fourth bearing surface. In an embodiment, the bottom of the cavity 150 is recessed below the elevation 163 and extends generally between the 12 o'clock and 6 o'clock positions and forms a sixth bearing surface 164. In an embodiment, the third bearing surface 158 rides on the fourth bearing surface/elevation 163 and the fifth bearing surface 159 rides on the sixth bearing surface 164. As the bearing structure 125 rotates within the cavity 150, the stop abutment 157 can rotate from the 12 o'clock position to the 6 o'clock position, generally about 180° until it abuts the side of elevation 163. In an embodiment, the end face bearing surface is formed by the third and fifth bearing surfaces. In an embodiment, the bottom bearing surface is formed by the fourth and sixth bearing surfaces.

FIG. 9 depicts the channel 142 oriented on the short side of the head 120. In an embodiment the channel 142 may be oriented in other locations around the circumference of the bearing surface 128 and bearing structure 125. For example, the channel 142 may be oriented 180° from its depiction in FIG. 9, so that it is disposed within the stop abutment 157 and has its opening on the long side of the head 120. Such an orientation would allow for an operator to depress the actuator 130 disposed within the channel 142 with his/her thumb; whereas in the orientation depicted in FIG. 9, an operator would be more comfortable depressing the actuator 130 with his/her index finger. It is to be understood that reorientation of the channel 142 and actuator 130 also would require the reorientation of the slots 155 within the cavity 150.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contributions. For example, while the bearing structure is depicted above on the head and the cavity on the body, this construction could be reversed by having the cavity formed in the head and a bearing structure on the body. Other actuators may also be provided such as levers, pins, latches, sleeves, buttons, clamps, bolts, hooks, lugs, etc. The actual scope of the protection sought is intended to be defined in the following claim when viewed in their proper perspective based on the prior art.

What is claimed is:

1. An adjustable-head hand tool comprising:

a body having a handle and a pivot axis;

a head mounted to the body for pivotal movement about the pivot axis;

an actuator carried by one of the body and the head for reciprocating movement between a release condition accommodating relative pivotal movement of the body and the head and a locking condition to lock the head in a predetermined position with respect to the body;

a bearing structure carried by one of the body and the head and received by a cavity of the other of the body and the head and the bearing structure having an end face bearing surface and the cavity having a bottom bearing surface and the bearing structure secured within the cavity by a boss so that the end face bearing surface and the bottom bearing surface are in abutting contact and upon which the head may be adjusted relative to the body;

one of the bearing structure and the cavity having a plurality of radial slots for receiving the actuator when in the locking condition; and wherein a pair of angular bearing surfaces are formed between the head and body and the bearing surfaces are formed at 45° from a longitudinal axis of the body.

2. The tool of claim 1 wherein, the bearing structure protrudes from the head and is received in a cavity formed in the body.

3. The tool of claim 1 wherein, the end face bearing surface includes a chamfer for engaging a corresponding chamfered surface of the cavity.

4. The tool of claim 1 wherein, the boss includes a retaining ring for securing the head to the body.

5. The tool of claim 1 wherein, the boss provides for a fastener that includes a screw that is threaded into the bearing structure in order to secure the bearing structure within the cavity.

6. The tool of claim 1 wherein, the boss includes a snap-fit cap.

7. The tool of claim 1 wherein, the bearing structure includes a channel for receiving the actuator.

8. The tool of claim 1 wherein, the actuator is slidably mounted in a channel formed in the body and in communication with the cavity.

9. The tool of claim 1 wherein, the actuator is slidably mounted in a channel formed in the head and in communication with the cavity.

10. The tool of claim 1 wherein, the head includes a ratchet mechanism for operation of a drive member protruding from the head.

11. The tool of claim 1 wherein, the actuator is generally L-shaped and includes a finger contact leg for engaging a finger of an operator's hand and a lock leg for engaging one of the slots.

12. The tool of claim 1 wherein, the slots are oriented around an inner diameter wall of the cavity and the actuator is mounted in a channel formed in the outer diameter wall of the bearing structure and the actuator is spring biased to provide the actuator in the locking condition by engaging one of the slots located adjacent the channel upon rotation of the head to the predetermined position.

13. The tool of claim 1 wherein, the cavity is formed by an insert having a hole for receiving the hub therethrough.

14. The tool of claim 1 wherein, the boss protrudes from the end face bearing surface of the bearing structure.

15. The tool of claim 1 wherein, the body includes a channel extending generally parallel to a longitudinal axis of the body and a passage extending generally perpendicular to and in communication with the channel.

16. The tool of claim 15 wherein, the actuator is generally T-shaped and includes an actuator body having a terminal end, an axial finger opposite the terminal end and a slide lever that extends from the actuator body, the actuator body disposed in the channel and the slide lever extending trough the passage and protruding from the body for engagement by an operator's finger in order to move the actuator.

17. The tool of claim 16 wherein, the terminal end of the actuator body is received within the cavity and engages one of the slots.

18. The tool of claim 16 wherein, the axial finger engages a spring disposed within the channel for biasing the actuator to the locking condition by engaging one the slots located adjacent the channel upon rotation of the head to the predetermined position.

19. The tool of claim 1 further including a stop abutment located on one of the bearing structure and the cavity for limiting rotation of the head to less than 360°.

20. The tool of claim 19 wherein, the stop abutment restricts rotation of the head to 180° or less.

21. An adjustable-head hand tool comprising:

a body having a handle and a pivot axis;

a head mourned to the body for pivotal movement about the pivot axis;

an actuator carried by one of the body and the head for reciprocating movement between a release condition accommodating relative pivotal movement of the body and the head and a locking condition to lock the head in a predetermined position with respect to the body;

a bearing structure carried by one of the body and the head and received by a cavity of the other of the body and the head and the bearing structure having an end face bearing surface and the cavity having a bottom bearing surface and the bearing structure secured within the cavity by a boss so that the end face bearing surface and the bottom bearing surface are in abutting contact and upon which the head may be adjusted relative to the body;

one of the bearing structure and the cavity having a plurality of radial slots for receiving the actuator when in the locking condition; and wherein the end face bearing surface includes a chamfer for engaging a corresponding chamfered surface of the cavity.

22. An adjustable-head hand tool comprising:

a body having a handle and a pivot axis;

a head mounted to the body for pivotal movement about the pivot axis;

an actuator carried by one of the body and the head for reciprocating movement between a release condition accommodating relative pivotal movement of the body and the head and a locking condition to lock the head in a predetermined position with respect to the body;

a bearing structure carried by one of the body and the head and received by a cavity of the other of the body and the head and the bearing structure having an end face bearing surface and the cavity having a bottom bearing surface and the bearing structure secured within the cavity by a boss so that the end face bearing surface and the bottom bearing surface are in abutting contact and upon which the head may be adjusted relative to the body;

one of the bearing structure and the cavity having a plurality of radial slots for receiving the actuator when in the locking condition;

wherein the body includes a channel extending generally parallel to a longitudinal axis of the body and a passage extending generally perpendicular to and in communication with the channel; and wherein the actuator is generally T-shaped and includes an actuator body having a terminal end, an axial finger opposite the terminal end and a slide lever that extends from the actuator body, the actuator body disposed in the channel and the slide lever extending through the passage and protruding from the body for engagement by an operator's finger in order to move the actuator.

23. The tool of claim 22 wherein, the terminal end of the actuator body is received within the cavity and engages one of the slots.

24. The tool of claim 22 wherein, the axial finger engages a spring disposed within the channel for biasing the actuator to the locking condition by engaging one the slots located adjacent the channel upon rotation of the head to the predetermined position.

* * * * *

UNITED STATES PATENT AND TRADEMARK OFFICE

CERTIFICATE OF CORRECTION

PATENT NO. : 7,481,135 B2
APPLICATION NO. : 11/881879
DATED : January 27, 2009
INVENTOR(S) : Michael D. Schoenbeck et al.

It is certified that error appears in the above-identified patent and that said Letters Patent is hereby corrected as shown below:

Column 10 line 50 "trough" should be "through".

Column 11 line 1 "mourned" should be "mounted"

Signed and Sealed this

Twenty-fourth Day of March, 2009

John Doll

JOHN DOLL
*Acting Director of the United States Patent and Trademark Office*